US006714488B1

(12) United States Patent
Vogel

(10) Patent No.: US 6,714,488 B1
(45) Date of Patent: Mar. 30, 2004

(54) KINETICHROME

(76) Inventor: Eric J. Vogel, 18824 Cherry La., Lansing, IL (US) 60438

( * ) Notice: Subject to any disclaimer, the term of this patent is extended or adjusted under 35 U.S.C. 154(b) by 0 days.

(21) Appl. No.: 10/235,473

(22) Filed: Sep. 4, 2002

Related U.S. Application Data

(60) Provisional application No. 60/316,631, filed on Sep. 4, 2001.

(51) Int. Cl.[7] ..... G04C 17/00; G04C 19/00

(52) U.S. Cl. ..... 368/223; 368/84; 368/242

(58) Field of Search ..... 368/223, 82–84, 368/239–242, 52–56

(56) References Cited

U.S. PATENT DOCUMENTS 3,969,887 A * 7/1976 Fukumoto ..... 368/242
4,436,435 A * 3/1984 Ushikoshi ..... 368/71
4,707,141 A 11/1987 Havel
4,953,952 A 9/1990 Okumura
5,228,013 A 7/1993 Bik
5,586,089 A * 12/1996 McGarvey ..... 368/223
5,636,185 A * 6/1997 Brewer et al. ..... 368/84
6,208,591 B1 * 3/2001 Sakurazawa et al. ..... 368/67
6,515,942 B2 * 2/2003 Basturk ..... 368/223
6,518,493 B1 * 2/2003 Murakami et al. ..... 136/257
6,521,822 B2 * 2/2003 Ito et al. ..... 136/244

* cited by examiner

*Primary Examiner*—Randy Gibson
*Assistant Examiner*—Michael L. Lindinger
(74) *Attorney, Agent, or Firm*—Matthew J. Peirce

(57) ABSTRACT

A watch is disclosed that includes a color changing feature that is created by using two polarized lenses, one of which is stationary, the other of which would rotate around a central axis. The presence of the two polarized lenses would create a display of color that would change depending on the orientation of one lens to the other. This design, with its central axis and circular shape, lends itself to be readily used on the face of a watch. This watch would then have the unique feature of a color changing face. With the top polarized lens attached to the watch mechanics, the lens would rotate slightly and with each movement the color of the entire face would slowly turn into another color as it changes through the entire color spectrum cycle.

4 Claims, 1 Drawing Sheet

KINETICHROME

This application claims the benefit of Provisional application Ser. No. 60/316,631, filed Sep. 4, 2001.

I. BACKGROUND OF THE INVENTION

The present invention concerns that of a new method of color change that can be adapted for use on a variety of products.

II. DESCRIPTION OF THE PRIOR ART

U.S. Pat. No. 5,636,185, issued to Brewer, discloses a dynamically changing color display for an electronic watch using a microprocessor controlled liquid crystal display.

U.S. Pat. No. 5,228,013, issued to Bik, discloses a microelectronic based timepiece with a liquid crystal display capable of changing color to indicate time.

U.S. Pat. No. 4,953,952, issued to Okumura, discloses a color liquid display panel using two light polarizing plates on opposite sides for improvements in brightness and viewing angle, capable of being used in a watch.

U.S. Pat. No. 4,707,141, issued to Havel, discloses an analog timepiece with a variable color display for providing an indication of the time.

III. SUMMARY OF THE INVENTION

A watch is disclosed that includes a color changing feature that is created by using two polarized lenses, one of which is stationary, the other of which would rotate around a central axis. The presence of the two polarized lenses would create a display of color that would change depending on the orientation of one lens to the other. This design, with its central axis and circular shape, lends itself to be readily used on the face of a watch. This watch would then have the unique feature of a color changing face. With the top polarized lens attached to the watch mechanics, the lens would rotate slightly and with each movement the color of the entire face would slowly turn into another color as it changes through the entire color spectrum cycle.

There has thus been outlined, rather broadly, the more important features of a watch including a color changing feature that the detailed description thereof that follows may be better understood and in order that the present contribution to the art may be better appreciated. There are, of course, additional features of the watch including a color changing feature that will be described hereinafter and which will form the subject matter of the claims appended hereto.

In this respect, before explaining at least one embodiment of the watch including a color changing feature in detail, it is to be understood that the watch including a color changing feature is not limited in its application to the details of construction and to the arrangements of the components set forth in the following description or illustrated in the drawings. The watch including a color changing feature is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present watch including a color changing feature. It is important, therefore, that the claims be regarded as including such equivalent constructions insofar as they do not depart from the spirit and scope of the present invention.

It is therefore an object of the present invention to provide a watch including a color changing feature which has all of the advantages of the prior art and none of the disadvantages.

It is another object of the present invention to provide a watch including a color changing feature which may be easily and efficiently manufactured and marketed.

It is another object of the present invention to provide a watch including a color changing feature which is of durable and reliable construction.

It is yet another object of the present invention to provide a watch including a color changing feature which is economically affordable and available for relevant purchasing government entities.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Priority is hereby claimed to application Ser. No. 60/316,631, filed on Sep. 4, 2001.

Figure 1:
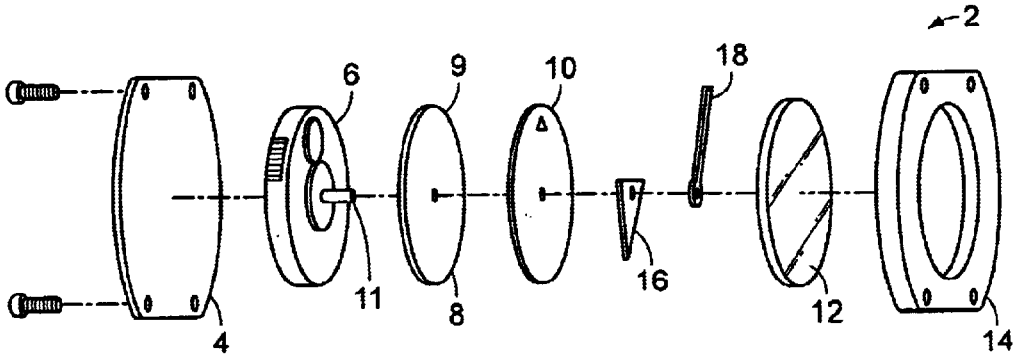
FIG. 1 shows a side view of the parts of the watch in the preferred embodiment.

FIG. 1 shows a side view of the parts of the watch in the preferred embodiment. This embodiment of watch 2 is fabricated from back plate 4, mechanics 6, polarized liquid crystal panel 8, polarized panel 10, glass covering 12, and front housing 14. In addition, hour hand 16 and minute hand 18 are attached to the mechanical movement above the polarized panel 10, which has a second hand marker printed on or adhered to the panel.

Back plate 4 has two sides, a rear side and a front side. The mechanics 6 of the watch would be attached to the front side of the back plate 4. Mechanics 6 of the water would include power means for powering the watch, and further, would include a quartz crystal-based time keeping system. Mechanics 6 would include a central spindle 11 that would extend upwards away from the back plate.

The polarized panel 8 would be circular and would be centrally placed over the spindle 11. Polarized panel 8 would have two surfaces, a rear surface and a front surface. The front surface of the polarized panel 8 would contain the watch markings, including the standard "1 through 12" that denotes five minute increments, and in addition, would include minute increment. Polarized panel 8 may have a reflective backing 9 to prevent viewing the mechanics 6 (since the polarized panels are transparent) and also to enhance the color of the watch face. When watch 2 would be fully assembled, polarized panel 8 would not rotate, while polarized panel 10 is mounted to the spindle 11 and does rotate.

Polarized panel 10 would be circular and would be centrally placed over the spindle 11 above polarized panel 8.

Polarized panel 10 would comprise a series of polarized panels, or sections, which would be configured in an overlapping pattern. As polarized panel 10 would rotate around the spindle 11, the color of the watch will change based on the rotation of polarized lens 10. The change in color over time will entirely depend on the speed that polarized lens 10 rotates. The combination of polarized liquid crystal panel 8 and the polarized lens 10 produce a wide variety of vivid color variations. The colors viewed when polarized lens 10 vibrates would preferably show off in the following order: purple, blue, blue-green, green, yellow, orange, red and violet.

Figure 2:
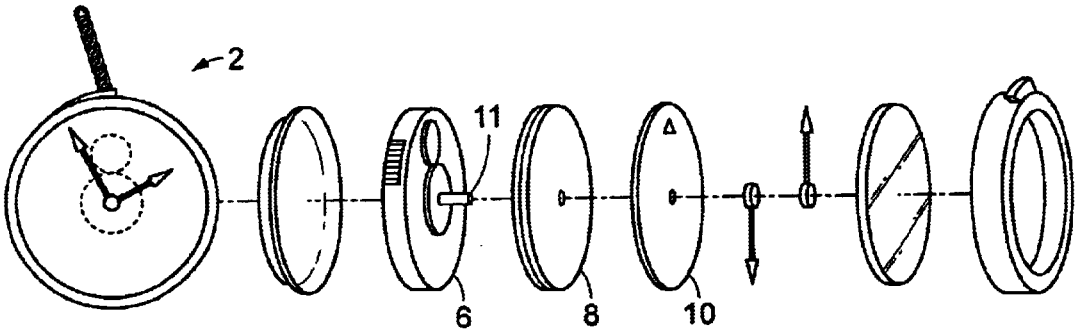
FIG. 2 shows a side view of the parts of the watch in a first alternative embodiment.

FIG. 2 shows a side view of the parts of the watch 2 in a first alternative embodiment. This first alternative embodiment of watch 2 would not have reflective backing 9, allowing a user to see the mechanics 6 of the watch 2 through a color changing "window." All the other parts would be the same as present in the preferred embodiment of watch 2 shown in FIG. 1.

Figure 3:
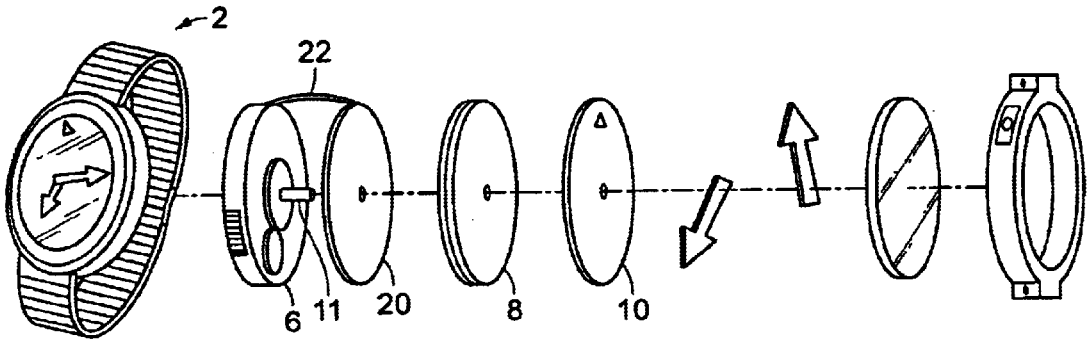
FIG. 3 shows a side view of the parts of the watch in a second alternative embodiment.

FIG. 3 shows a side view of the parts of the watch 2 in a second alternative embodiment. In this embodiment, no reflective backing 9 would be present. In addition, the watch 2 would have a white electro-luminescent panel 20 which would be present to allow the color change to be visible at night. An electrical connection 22 would be present between mechanics 6 and electro-luminescent panel 20 in order to provide power to electro-luminescent panel 20.

Other embodiments of watch 2 could be configured in which a user could rotate the polarized lens 10 to pick a particular color, with polarized lens 10 not freely rotating on its own. A wide variety of other embodiments could also be configured with watch 2 of the present invention by making slight inexpensive modifications to the embodiments already disclosed. Other embodiments outside the watch category are also possible for kinetichrome and will be specifically detailed in upcoming utility patent on this invention.

What I claim as my invention is:

1. A watch comprising:

(a) a back plate having two surfaces, a front surface and a rear surface, (b) watch mechanics attached to the front surface of the back plate, the watch mechanics including a power source, the watch mechanics including a central spindle attached to the back plate, the spindle extending away from the back plate, the spindle designed to rotate when the watch is running, (c) a polarized liquid crystal panel centrally placed over the spindle, the polarized liquid crystal panel having two surfaces, a front surface and a rear surface, (d) a plurality of clock markings on the front surface of the polarized liquid crystal panel, (e) a polarized panel axially mounted onto the spindle, the polarized panel comprising a plurality of individual polarized sections, the sections being configured in an overlapping pattern, (f) a pair of hands comprising a minute hand and an hour hand, the minute hand and the hour hand pivotally attached to the spindle, (g) a glass covering placed over the pair of hands, (h) a front housing placed over the glass covering, (i) wherein the polarized panel axially mounted onto the spin would rotate around the spindle at a specific speed, causing the light emitted from the polarized liquid crystal panel to be viewed in varying colors in successive order.

2. A watch according to claim 1 wherein the rear surface of the polarized liquid crystal panel would further include a reflective backing.

3. A watch according to claim 1 wherein the watch would further comprise a white electro-luminescent panel, the panel located between the watch mechanics and the polarized liquid crystal panel, the panel providing light allowing the watch to viewed at night.

4. A watch according to claim 1 wherein the light emitted from the polarized liquid crystal panel would be viewed in varying colors in the following order: purple, blue, blue-green, green, yellow, orange, red and violet.

* * * * *